US005611438A

United States Patent [19]

Dye

[11] Patent Number: 5,611,438

[45] Date of Patent: Mar. 18, 1997

[54] PRODUCT DISPLAY AND DISPLAY HOOK FOR USE IN SAME

[75] Inventor: Robert G. Dye, Weehauken, N.J.

[73] Assignee: Chesapeake Display & Packaging Company, Winston-Salem, N.C.

[21] Appl. No.: 512,116

[22] Filed: Aug. 7, 1995

[51] Int. Cl.[6] ..... A47F 5/00

[52] U.S. Cl. ..... 211/57.1; 211/59.1; 248/220.43; 248/221.11

[58] Field of Search ..... 211/57.1, 59.1, 211/87; 248/220.31, 220.41, 220.43, 221.11, 229.23, 229.24

[56] References Cited

U.S. PATENT DOCUMENTS

| | | | |
|---|---|---|---|
| 3,481,487 | 12/1969 | Paruolo | 248/220.41 |
| 4,059,190 | 11/1977 | Conway | 211/57.1 |
| 4,441,619 | 4/1984 | Gibitz . | |
| 4,671,417 | 6/1987 | O'Brien . | |
| 4,860,905 | 8/1989 | Schott et al. . | |
| 4,989,815 | 2/1991 | McAuley . | |
| 5,375,803 | 12/1994 | Kump . | |
| 5,503,277 | 4/1996 | O'Brien | 211/59.1 X |

*Primary Examiner*—Robert W. Gibson, Jr.
*Attorney, Agent, or Firm*—Bell, Seltzer, Park & Gibson, P.A.

[57] ABSTRACT

There is provided a point-of-purchase display which includes a support panel having at least one generally vertical planar forward facing side and at least one horizontal mounting slot and a mounting hole located at a predetermined distance from the slot and a product display hook for mounting to the panel through the slot and the opening. The display hook is easily inserted through the horizontal slot in the support panel and mounted to the panel by securing a portion of the hook mounting mechanism through the opening. The display hook includes a front plate having a forwardly projecting hook shank extending from said plate and preferably inclined slightly upwardly. At or near the top edge for the front panel is a connecting member for mounting the hook to the panel. The connecting member connects the front plate to a rear plate which when mounted to a panel is located at the rear side of the panel. The connecting member extends rearwardly from the opposite side of the front plate from the hook shank. The connecting member is adapted to extend through the horizontal slot in the panel. A hinge is pivotally secured along the rear edge of the connecting member and to one edge of the rear plate. A closure element is provided at the other horizontal edge of the rear plate for securing the rear plate through the opening to the front plate. A preferred closure element is a prong having a latching notch therein formed integrally with and perpendicular to the lower portion of the front plate and adapted to extend through the panel. The rear panel is sized so that its lower edge is adapted to fit into the notch when the hook is properly mounted.

20 Claims, 2 Drawing Sheets

PRODUCT DISPLAY AND DISPLAY HOOK FOR USE IN SAME

BACKGROUND OF THE INVENTION

1. Field of the Invention

This invention relates to a point-of-purchase product display. More particularly, this invention relates to a display hook for use with a point-of-purchase display.

2. The Prior Art

The proper display of retail merchandise will greatly aid in the sales of the displayed products. Studies have shown that point-of-purchase displays are useful in increasing sales over conventional shelf displays. Such point-of-purchase displays may vary in terms of their elaborateness but generally include a vertical panel which has hooks mounted to the panel at predetermined intervals to display the merchandise.

Typically, the point-of-purchase display will be positioned as a support panel against a wall or will be a free-standing rack, often supplied by the manufacturer. In such circumstances, the display will usually be printed with indicia of the manufacturer. Also, while the manufacturer or the store owner may be cost-conscious regarding the cost of the display, it is equally important that the hooks be so mounted on the panel as to not be accidentally knocked off or be removed from the panel in normal use. The hooks should also be mounted in such a manner that forces from the weight of the displayed merchandise will not injure the support panel on which the hook is attached.

An example of a point-of-purchase display system is shown by O'Brien in U.S. Pat. No. 4,671,417 which provides a display hook having a downwardly projecting rear finger which closely conforms to the horizontal slot and hooks over the lower edge of the slot. The finger exerts a spring pressure against the back of the panel below the slot. A downward force on the forwardly projecting hook tends to pull the top of the finger forward and may tear the panel. Moreover, such force tends to reduce the spring pressure of the finger against the back of the panel below the slot.

In another example, there is provided in U.S. Pat. No. 4,860,905, a point-of-purchase display and method of forming the display. The display uses a similar type of hook but with an upwardly facing rear finger and describes a display hook having a sufficiently large front panel to cover an opening in the support panel yet being of such size that when it is positioned within the opening, it is rotated 90° to a position where spring pressure tends to hold the mounting end of the hook to the panel if a downward load is placed on the projecting hook.

The above-described display hooks have a tendency to pull loose from the display panel when heavy loads are placed on the hooks or they may be dislodged from their place on the panel when merchandise is removed. It is therefore desirable to provide a hook that is easily mounted to the panel but which, when fastened in place, is not easily removed during normal usage.

SUMMARY OF THE INVENTION

A point-of-purchase display which includes a support panel having at least one generally vertical planar forward facing side and at least one horizontal mounting slot and a mounting hole located at a predetermined distance from the slot, and a product display hook for mounting to the panel through the slot and the opening. The display hook is easily inserted through the horizontal slot in the support panel and mounted to the panel by securing a rear portion of the hook mounting mechanism through the opening to the front portion.

The display hook includes a substantially planar front plate having a forwardly projecting product support member which includes a shank extending outwardly from the front face of the front plate and is preferably inclined slightly upwardly from the horizontal. The display hook includes a means for mounting the display hook to the support panel. At or near the top edge of the front plate is a connecting member for connecting the front plate to a rear plate which, when mounted, is located at the rear side of the support panel. The connecting member extends perpendicular to and rearwardly from the rear face of the front plate. The connecting member is adapted to extend through the horizontal slot in the support panel. A hinge is pivotally secured along the rear edge of the connecting member and to one horizontal edge of the rear plate. A closure element is provided for securing the rear plate through the opening to the front plate. A preferred closure element includes a prong formed integrally with and perpendicular to the lower portion of the rear face of the front plate and which is adapted to extend through the opening in the support panel. The prong has a latching notch in its upper surface. The rear panel is sized so that its lower edge is adapted to fit into the notch when the display hook is mounted to the support panel.

It is therefore an object of the present invention to provide a point-of-purchase display having a product display hook which may be securely mounted to a support panel.

Another object of the present invention is to provide a product display hook which may be securely mounted to a support panel but is readily movable to a different location on the panel.

Other objects, advantages, and features of the present invention, and the manner in which the same may be accomplished, will become more apparent upon consideration of the following detailed description of the invention taken in conjunction with the accompanying drawings, which illustrate a preferred and exemplary embodiment.

DETAILED DESCRIPTION OF THE PREFERRED EMBODIMENTS

Figure 1:
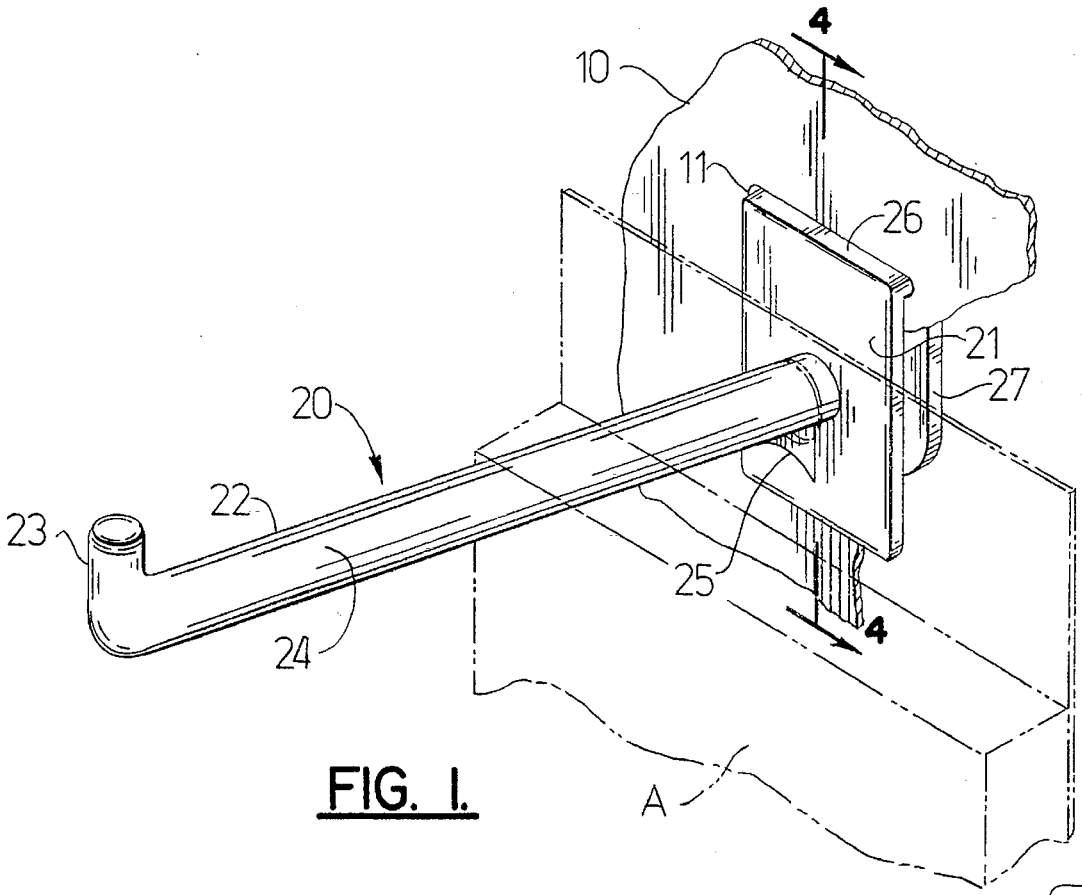
FIG. 1 is a fragmentary perspective of the present invention showing the product display hook mounted to a support panel.
Figure 2:
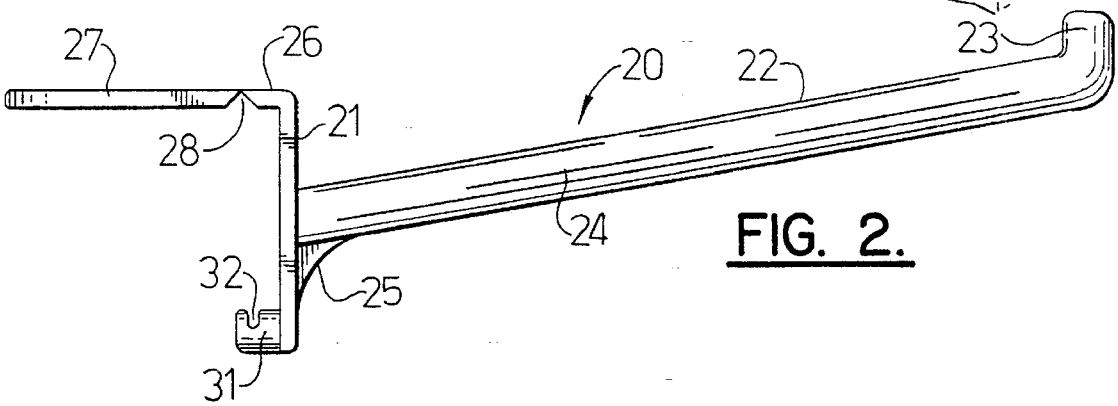
FIG. 2 is a side view of the product display hook of the present invention showing the mounting mechanism in open position.
Figure 3:
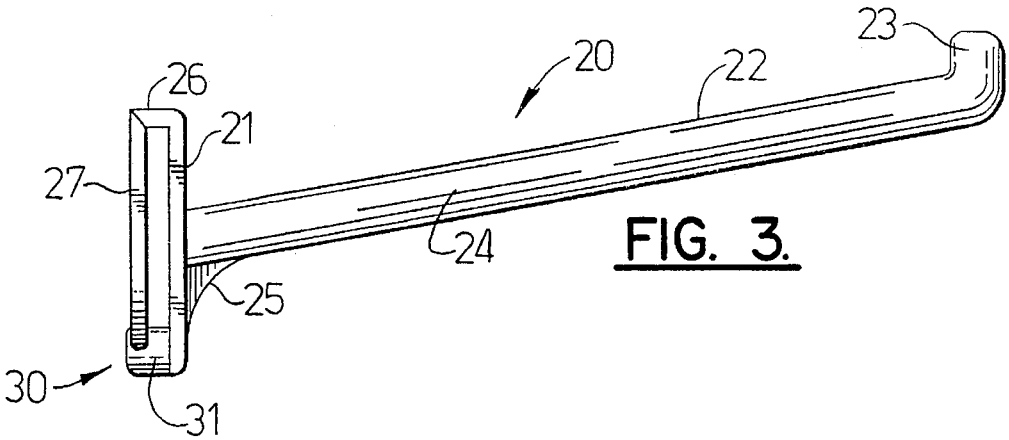
FIG. 3 is a side view of the product display hook of the present invention showing the mounting mechanism in closed position.
Figure 4:
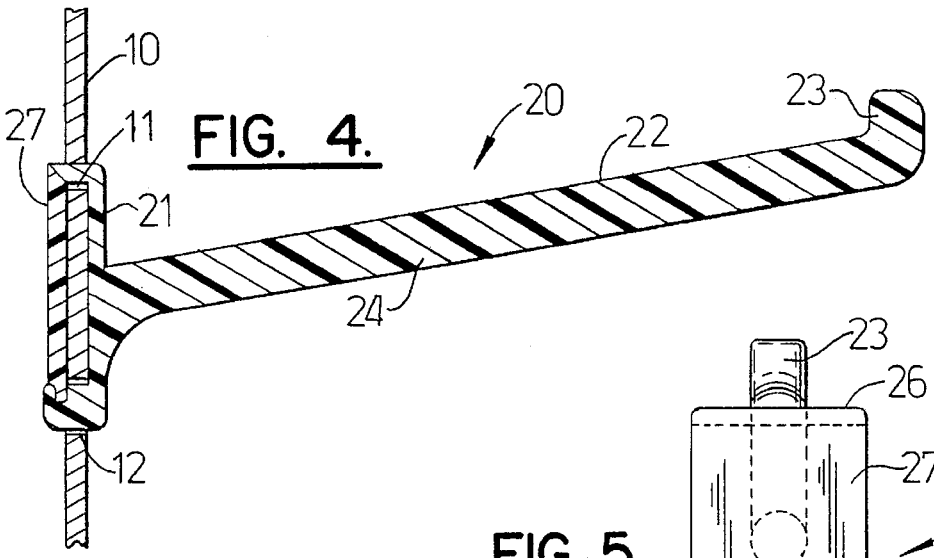
FIG. 4 is a side view of the releasable display hook of the present invention taken along line 4—4 of FIG. 1.
Figure 5:
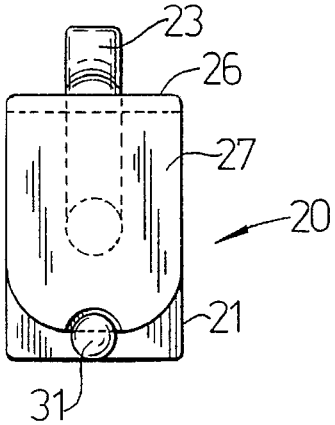
FIG. 5 a rear view of the product display hook of the present invention.
Figure 6:
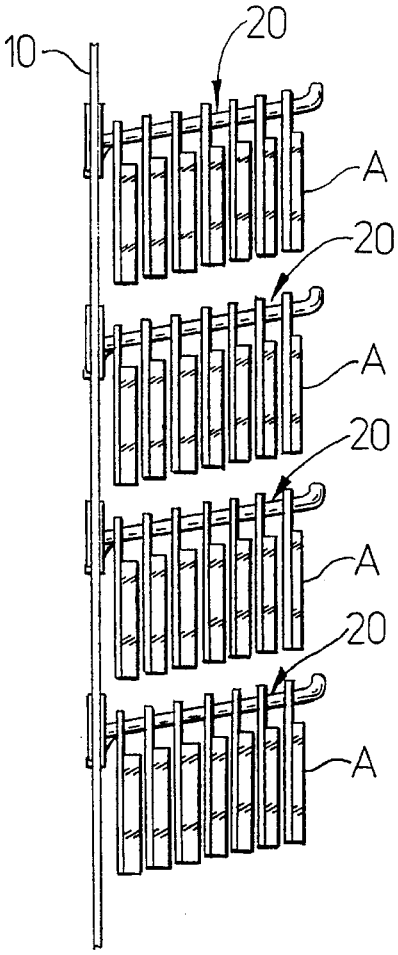
FIG. 6 is a sectional view through the side of a point-of-purchase display using the product display hooks of the present invention which have been loaded with a product for display.

Referring now to the drawings, there is shown in FIGS. 1 and 6, a product display having a display hook 20 mounted to a panel 10, such as a those used for point-of-purchase displays of merchandise A. While the display hook is primarily designed for, and will be described in connection with, retail point-of-purchase displays, it should be appreciated that these hooks can also be used in other environments, such as hooks for holding tools and supplies in a home workshop. The support panel 10 is provided with a series of regularly spaced horizontal elongated slots 11 and holes 12 (see FIG. 4) through which the display hooks 20 are mounted. The support panel may be any of the well-known materials used for point-of-purchase displays such as cardboard, corrugated cardboard, or plastic, for example. Because the display hooks are removable, the location of the display hooks on the support panel may be easily changed to accommodate different merchandise.

In FIGS. 2–5, it will be seen that the product display hook 20 includes a front plate 21 which is generally vertically elongated and rectangular but substantially larger than the configuration of slot 11 and has substantially planar front and rear faces. The display hook 20 has an elongated product support member 22 which is cantilevered outwardly from the front face of front plate 21. Support member 22 extends upwardly at a slight incline from the horizontal and terminates in an upturned tip portion 23. It should be understood that the length of the shank 24 of the support member will vary in length. Typical lengths would be 2, 4 and 6 inches and the length will depend on the merchandise to be displayed. At the juncture of the shank 24 with the front of the face plate 21 there is provided a reinforcing support 25 underneath the shank 24.

The display hook includes a mounting mechanism for attached the hook to the support panel. At or near the top of the front plate 21 there is provided a connecting member 26 for connecting the front plate 21 to a rear plate 27. The connecting member 26 is rectangular-shaped and extends perpendicularly rearwardly of the front plate. The connecting member 26 extends rearwardly from the front plate 21 and is adapted to extend through the horizontal slot A hinge 28 is provided along one edge of the connecting member 26 that is pivotally secured to the upper end of the rear plate 27. One preferred hinge is commonly known as a "living hinge". A closure member 30 is provided for securing the other end of rear plate 27 through the opening 12 in the support panel 11 to the front plate. The closure member 30, in one preferred embodiment, includes a prong 31 attached to the lower portion of the front plate and extending perpendicular thereto through the opening 12 in panel 11. The prong 31 includes a latching means shown as notch 32 for securing the front and rear plates together so as to securely mount the display hook to the support panel. As will be appreciated by those skilled in the art, the connecting member 26 may be positioned at the bottom of front plate 21 and the closure member 30 near the top of the front plate.

It is noted that both the front plate 21 and the rear plate 27 are generally rectangular. The rear plate 27 is somewhat shorter than the front plate, extending from the area of the hinge for such length that when closed it fits into the area of notch 32. In addition, the width of the connecting member and the rear plate may be narrower than the front plate and slightly narrower than the width of the slot 11 to facilitate mounting of the display hook.

An example of displayed merchandise using the display hooks of the present invention is shown in FIG. 6 wherein there is shown a number of the releasable display hooks of the present invention attached to a support panel and having displayed items placed on the shank of the display hook. The closure mechanism of the present invention absorbs the forces from the items displayed on the shank, thereby lessening any damage to the slotted areas of the panel. The display hooks are preferably made of one piece and may readily be formed by injection molding with suitable plastics such as polypropylene.

The display hook is attached to the panel by inserting the rear plate 27 and the connecting member 26 through slot 11, folding the rear plate 27 downwardly at the hinge area, and inserting the other end of rear plate 27 into the notch 32 of prong 31 thereby securing the display hook 20 to the panel 10.

It can now be seen that there is provided a display hook which is easy to mount to a support panel by simply inserting the rear plate and connecting member through the horizontal slot and prong through the opening and then closing the rear panel into the notch to mount the display hook to the support panel. An advantage of the mounting mechanism of the present invention is that the mechanism prevents wobbling or loosening of the display hook while mounted to the support panel.

The invention has been described in detail with particular reference to a preferred embodiment and the operation thereof, but it is understood that variations, modifications, and substitution of equivalent means can be effected within the spirit and scope of this invention.

What is claimed is:

1. A display hook for use in a point-of-purchase display of the type having a support panel containing a horizontal slot therethrough and an opening at a predetermined distance from said slot for mounting said display hook thereto comprising: a front plate having a front face and a rear face; a product support member having a shank extending outwardly from said front face of said front plate; a connecting member for connecting said front plate to a rear plate; said connecting member extending rearwardly from said rear face of said front plate and adapted to extend through said slot; a hinge along which one edge of said rear plate is pivotally secured to one side and the other side of said hinge being secured to an edge of said rear plate; and a closure element for securing the opposite edge of said rear plate through said opening to said front plate.

2. The product display hook according to claim 1 wherein said front and rear plates are generally rectangular.

3. The product display hook according to claim 1 wherein said product support member is inclined slightly upwardly from the horizontal.

4. The product display hook according to claim 1 wherein said rear plate is attached to said connecting member via a living hinge.

5. The product display hook according to claim 1 wherein said connecting member is positioned at the top of said front plate.

6. The product display hook according to claim 5 wherein said closure member comprises a prong attached to the lower portion of the rear face of said front plate and having a latching means for securing said plates together.

7. The product display hook according to claim 6 wherein said rear plate is slightly smaller than said front plate and adapted to fit into a notch when said closing mechanism is closed.

8. The product display hook according to claim 1 wherein said product display hook is formed of plastic.

9. The product display hook according to claim 1 further comprising a reinforcing support underneath said hook shank.

10. The product display hook according to claim 1 wherein said connecting member is positioned at the bottom of said front plate.

11. The product display hook according to claim 10 wherein said closure member comprises a prong attached to the upper portion of the rear face of said front plate and having a latching means for securing said plates together.

12. The product display hook according to claim 11 wherein said rear plate is slightly smaller than said front plate and adapted to fit into a notch when said closing mechanism is closed.

13. A point-of-purchase product display comprising:

a support panel having at least one generally vertical, planar forward facing side, said vertical side having at least one horizontal, a mounting slot and opening therethrough; and a product display hook having a front plate having a front face and a rear face, a product support member having a shank extending outwardly from said front face of said front plate, a connecting member for connecting said front plate to a rear plate, said connecting member extending rearwardly from said front plate and adapted to extend through said slot, a hinge along which said connecting member is pivotally secured to one end of said rear plate, and a closure element for securing said rear plate through said opening to said front plate.

14. The point-of-purchase product display according to claim 13, wherein said panel is cardboard.

15. The point-of-purchase product display according to claim 13, wherein said panel is corrugated cardboard carton stock.

16. The point-of-purchase product display according to claim 13 wherein said front and rear plates are generally rectangular.

17. The point-of-purchase product display according to claim 13 wherein said product support member is inclined slightly upwardly from the horizontal.

18. The point-of-purchase product display according to claim 13 wherein said rear plate is attached to said connecting member via a living hinge.

19. The point-of-purchase product display according to claim 13 wherein said closure member comprises a prong attached to the lower portion of the rear face of said front plate and extends through said opening and having a latching means for securing said plates together.

20. The point-of-purchase product display according to claim 13 wherein said rear plate is slightly smaller than said front plate and adapted to fit into a notch when said closing mechanism is closed.

* * * * *

UNITED STATES PATENT AND TRADEMARK OFFICE
CERTIFICATE OF CORRECTION

PATENT NO. : 5,611,438

DATED : March 18, 1997

INVENTOR(S) : Robert G. Dye

It is certified that error appears in the above-identified patent and that said Letters Patent is hereby corrected as shown below:

Column 2, last line, after "as" omit "a".

Column 3, line 31, delete "attached" and insert --attaching-- therefor.

Column 3, line 37, after "slot" insert --11--.

Column 5, line 12, after "horizontal" delete ", a" and after "and" insert --an--.

Column 3, lines 43 and 46, delete "panel 11" and insert --panel 10-- therefor.

Signed and Sealed this

Nineteenth Day of August, 1997

*Attest:*

Bruce Lehman

BRUCE LEHMAN

*Attesting Officer*

*Commissioner of Patents and Trademarks*